United States Patent [19]

Apaloo et al.

[11] 4,066,869

[45] Jan. 3, 1978

[54] COMPRESSOR LUBRICATING OIL HEATER CONTROL

[75] Inventors: Thomas L. Apaloo, Carson; Wayne H. Garside, Arcadia; Isaac Berger, Hacienda Heights, all of Calif.

[73] Assignee: Carrier Corporation, Syracuse, N.Y.

[21] Appl. No.: 530,250

[22] Filed: Dec. 6, 1974

[51] Int. Cl.[2] ..... H05B 1/02

[52] U.S. Cl. ..... 219/490; 62/84; 62/472; 184/6.22; 184/104 R; 219/205; 417/14; 417/32

[58] Field of Search ..... 184/6.1, 6.22, 104 R; 219/306, 307, 316, 319, 323, 327, 490, 200, 205, 201; 62/148, 202, 208, 228, 84, 472; 417/14, 32, 228

[56] References Cited

U.S. PATENT DOCUMENTS

| | | | |
|---|---|---|---|
| 1,775,781 | 9/1930 | Parkins | 184/104 R |
| 2,133,394 | 10/1938 | Mortier | 184/104 R |
| 2,388,523 | 11/1945 | Buechel | 184/6.22 |
| 3,577,741 | 5/1971 | Shaw | 62/84 |

*Primary Examiner*—J. V. Truhe
*Assistant Examiner*—Fred E. Bell
*Attorney, Agent, or Firm*—J. Raymond Curtin; Barry E. Deutsch

[57] ABSTRACT

A control for selectively energizing a heater provided to raise the temperature of lubricating oil of a compressor employed in a refrigeration unit. The control includes a thermostatically operated switch provided to sense a temperature indicative of lubricating oil temperature. The switch connects the heater to a source of electrical energy when the sensed temperature falls below a predetermined value and the compressor is inoperable. When the compressor is operable, the heater is rendered inoperable irrespective of the sensed temperature.

5 Claims, 4 Drawing Figures

COMPRESSOR LUBRICATING OIL HEATER CONTROL

BACKGROUND OF THE INVENTION

This invention relates to a control for energizing a heater provided to raise the temperature of lubricating oil of a compressor, and in particular to a control for selectively energizing the heater in response to a temperature indicative of the lubricating oil temperature.

It is well known that under certain conditions, some refrigerants and oil used as a lubricant for the compressor of a refrigeration unit are freely miscible. During normal operation of the refrigeration circuit, because of operating pressures and temperatures, the oil in the sump of the compressor, will be substantially free of refrigerant. However, on shutdown when the circuit reaches ambient temperature, and the pressure equalizes within the circuit, the refrigerant vapor and oil in the sump of the compressor will mix to form a substantially homogenous solution. This phenomenon becomes increasingly evident as the ambient temperature decreases.

Upon startup of the compressor, the oil sump which is usually a part of the crankcase of the compressor drops to suction pressure and the compressor mechanism may agitate the mixture of lubricating oil and refrigerant. The combination of the drop in suction pressure and possible mechanical agitation causes the refrigerant in solution to attempt to return to its vapor state. Since the refrigerant at shutdown is in a substantially homogenous solution, the flashing of admixed liquid refrigerant to vapor may carry therewith a substantial amount of the oil charge and may even result in the entire solution turning into a foam.

Foaming of the oil will materially increase the amount of oil carried over into the refrigerant discharge line. Foaming may become so severe that all of the oil is pumped out of the sump. Not only will this leave the compressor without lubrication, which may produce excessive bearing wear and bearing failure in a very short period of operation, but there is also the possibility that noncompressible slugs of liquid refrigerant and oil will enter the compressor's cylinders and cause serious damage to the compressor in the form of broken valves and pistons and bent or broken connecting rods and shafts.

To avoid the problem of crankcase oil dilution, heaters are generally employed. The heater may be an electrical resistance element. The resistance element may either be installed directly in the sump of the compressor, in direct contact with the oil, or may be wrapped around the outer surface of the compressor casing in heat transfer relation with the oil stored in the sump. The energization of the heater will maintain the lubricating oil at a satisfactory temperature above ambient temperature, for example 40° to 60° F above the ambient. At this temperature, only a small amount of refrigerant will be absorbed by the oil charge.

Heretofore, it has been the practice within the industry to either maintain the heater energized at all times regardless of the operation of the refrigeration unit or of the temperature of the ambient. Alternatively, it has been the practice to render the heater inoperable when the refrigeration unit is functioning and to energize the heater when the refrigeration unit has been shut down. In either case, operation of the heater, when the ambient temperature is above a predetermined level, for example 70° F, is wasteful of energy. When the temperature of the ambient is relatively warm, only a relatively small amount of refrigerant will be absorbed by the lubricating oil during the time in which the refrigeration unit is inoperable. The minimal quantity of refrigerant that may be absorbed, will not cause damage to the compressor and thus may be tolerated. At a time when the conservation of energy is in the national interests, and when it has been increasingly desirable to decrease operating costs, it is evident that the continued operation of an electrical device, such as the aforedescribed heater, when such operation is not required, is extremely undesirable.

SUMMARY OF THE INVENTION

It is accordingly an object of the invention to render a heater associated with the compressor of a refrigeration unit inoperable when the temperature of the lubricating oil is above a predetermined level and the compressor is inoperable.

It is a more specific object of the present invention to sense the temperature of lubricating oil and inactivate a lubricating oil heater when the temperature is above a predetermined level and the compressor is inoperable and to activate such heater when the temperature falls below the predetermined level and the compressor is inoperable.

It is yet another object of this invention to sense the temperature of the ambient and activate a heater when the temperature is below a predetermined level and the compressor is inoperable.

It is a further object of the present invention to sense a temperature indicative of lubricating oil temperature and to activate a heater when the sensed temperature is below a predetermined level.

These and other objects of the present invention are obtained by providing a control for selectively energizing a heater provided to raise the temperature of lubricating oil of a compressor employed in a refrigeration unit. A thermostatically operated switch is associated with the heater for selectively connecting the heater to a source of electrical energy. The switch is responsive to a temperature indicative of lubricating oil temperature and to operation of the compressor. The switch energizes the heater when the sensed temperature falls below a predetermined level and the compressor is not in operation. The switch deenergizes the heater when the compressor is operable regardless of the temperature of the ambient.

DESCRIPTION OF THE PREFERRED EMBODIMENTS

Referring now to the various Figures of the drawings, there is disclosed a lubricating oil heater control in accordance with the present invention. In referring to the various Figures of the drawings, like numerals shall refer to like parts.

Figure 1:
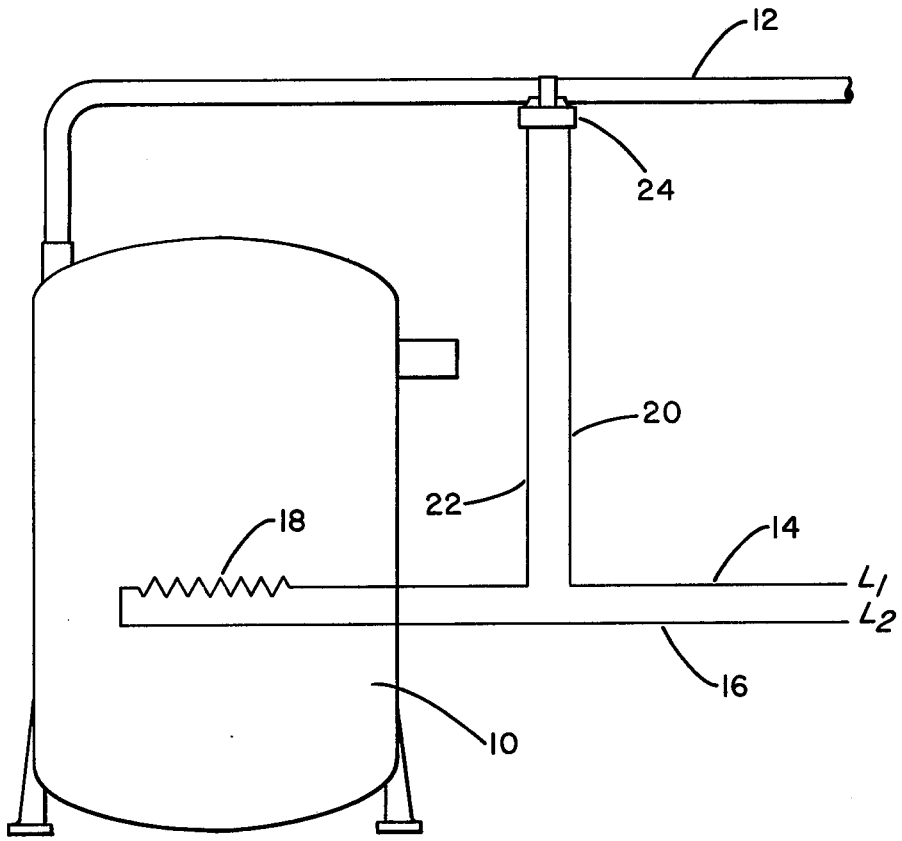
FIG. 1 schematically illustrates a control in accordance with the present invention.
Figure 4:
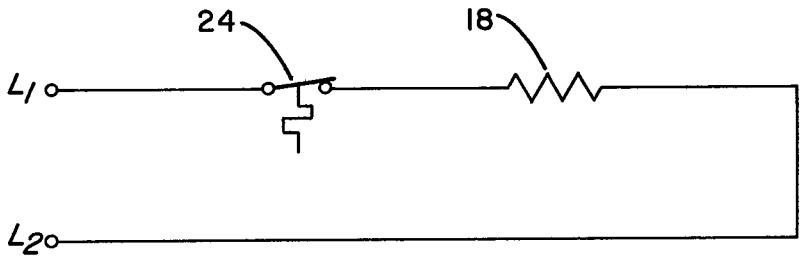
FIG. 4 schematically illustrates a portion of an electrical circuit that may be employed in the present invention.

Referring now in particular to FIG. 1, there is disclosed a hermetically sealed motor compressor unit 10 of a type suitable for use in a refrigeration unit. Motor compressor unit 10 is of conventional construction and therefore a detailed description thereof is deemed unnecessary. Unit 10 includes a sump portion 30 (see FIG. 3) where oil used for lubricating the various parts of the motor compressor unit is stored. At relatively low temperature levels, typically occurring when the motor compressor unit is inoperable, the lubricating oil will absorb refrigerant employed in the unit whereby problems as described hereinabove may result.

To avoid the undesirable occurrences, a heater 18 which may comprise a resistance coil, is suitably mounted in heat transfer relation with the oil stored in the sump. The heater may be disposed in various ways in relation to the sump; typically it is wrapped around the hermetic shell to provide heat to the shell and thereby raise the temperature of the oil located therewithin, or in the alternative, the heater may be installed directly in the sump in direct contact with the lubricating oil.

Heater 18 is connected to a suitable source of electrical energy represented by L1 and L2. Conductors 14 and 16 connect the heater to the source of energy. A control device 24 is connected in series with heater 18 and the source of electrical energy via conductors 20 and 22.

Device 24 preferably includes a normally opened thermostatically operated switch connected in series with heater 18. The closure of the switch portion of device 24 energizes the heater to raise the temperature of the lubricating oil as required.

In a first embodiment, device 24 is mounted so a portion thereof is in heat transfer relation with discharge line 12. When the motor compressor unit is in operation, high pressure, high temperature refrigerant gas passes through the line to the condenser of the refrigeration unit.

Switch 24 is responsive to the temperature of the ambient. The temperature of the ambient is indicative of the temperature of the lubricating oil when the compressor is inoperable. When the temperature of the ambient falls below a predetermined level, for example 70° F, and the compressor unit 10 is inoperable as indicated by the absence of relatively high temperature refrigerant in discharge line 12, the switch portion of device 24 will close to connect heater 18 to the source of electrical energy. The relatively low ambient temperature indicates that the oil will also be at a relatively low temperature level whereby a large quantity of refrigerant may be absorbed by the oil. The heater is thus activated to provide the necessary warmth to the lubricating oil to prevent refrigerant absorption thereby.

Irrespective of the temperature of the ambient, when the compressor is operating and thereby delivering high temperature refrigerant gas through line 12, device 24 will sense the presence of a high temperature gas and the switch portion thereof will open to deenergize heater 18. Thus, operation of the compressor will override the sensed ambient temperature to deenergize the heater irrespective of ambient temperature. Similarly, even though the compressor is off, if device 24 senses that the temperature of the ambient is above a predetermined level, for example 70° F, the switch portion thereof will open, thereby deenergizing heater 18. When the temperature of the ambient is above the predetermined level, sufficient heat will be transferred from the ambient to the lubricating oil to maintain the lubricating oil at a temperature whereby only a minimum quantity of refrigeration will be absorbed.

Figure 2:
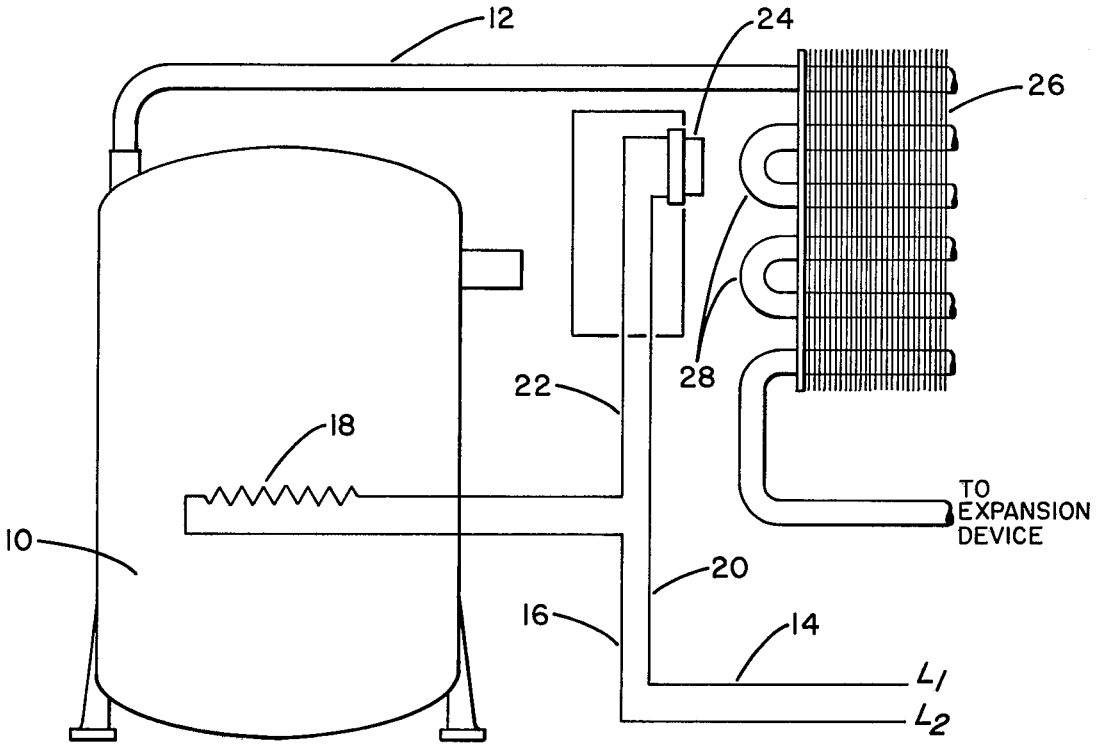
FIG. 2 schematically illustrates a second embodiment of the present invention.

Referring now to FIG. 2, there is disclosed an alternate arrangement of the present invention. Device 24 is mounted so that it is effected by heat radiated from condenser 26 when motor compressor unit 10 is in operation. Discharge line 12 delivers the high pressure, high temperature refrigerant gas to condenser 26 where the gas is condensed by the passage of a suitable cooling medium in heat transfer relation therewith. Preferably, device 24 is disposed adjacent return bends 28 of the refrigerant flow path through condenser 26.

In the embodiment illustrated in FIG. 2, when the compressor is inactive, the operation of device 24 will be the same as heretofore described. That is to say, device 24 will cause heater 18 to be energized when the temperature of the ambient falls below a predetermined level, and to be deenergized when the temperature increases above the predetermined level.

When the motor compressor unit is energized, the flow of high temperature refrigerant through condenser 26 will cause heat to be radiated from return bends 28. The radiated heat will be sensed by device 24, thereby causing the switch portion thereof to open to deenergize heater 18.

Figure 3:
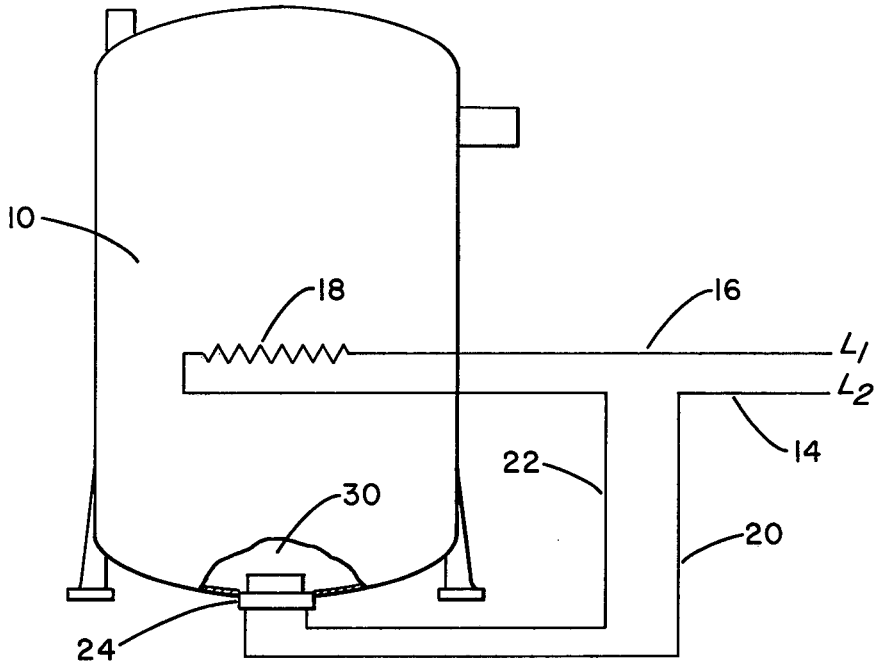
FIG. 3 schematically illustrates yet another embodiment of the present invention.

Referring now to FIG. 3, there is disclosed another embodiment of the present invention. Device 24 is disposed to directly sense the temperature of the lubricating oil in oil sump 30. When the compressor is deenergized, the switch portion of device 24 will operate in response to the actual lubricating oil temperature. When the temperature of the ambient is relatively warm, sufficient heat will be transferred to the oil to maintain the temperature thereof above a predetermined level whereby operation of heater 18 is not required. When device 24 senses that insufficient heat has been transferred to the oil from the ambient due to the ambient being at a relatively low temperature level, device 24 will connect heater 18 to the source of electrical energy. When the compressor is operable, the temperature of the lubricating oil will increase irrespective of ambient temperature thereby causing the switch portion of device 24 to open to render the heater 18 inoperable.

The present invention contemplates a relatively inexpensive control which may result in substantial operating efficiencies. By inactivating the lubricating oil heater at all times except when the operation thereof is absolutely necessary, a savings in operating costs and a conservation of energy will both be obtained.

While preferred embodiments of the present invention have been described and illustrated, the present invention should not be limited thereto, but may be otherwise embodied within the scope of the following claims.

We claim:

1. A control for selectively energizing a heater provided to raise the temperature of lubricating oil of a compressor employed in a refrigeration unit comprising:

means to provide electrical energy to said heater; and thermostatically operated switch means associated with said heater for selectively connecting said heater to said source of electrical energy, said switch means being responsive to the temperature of the ambient to connect said heater to said source of electrical energy when the sensed temperature is below a predetermined level and the compressor is deenergized, with said switch means disconnecting said heater from said source of electrical energy when the sensed ambient temperature exceeds said predetermined level or when said compressor is energized regardless of the ambient temperature.

2. A control in accordance with claim 1, wherein said switch means is located on the refrigerant line connecting the discharge side of compressor to the refrigerant condenser.

3. A control in accordance with claim 1, wherein said switch means is provided adjacent the refrigerant condenser to thus be affected by heat radiated from the surface of said condenser when the compressor of said refrigeration unit is in operation.

4. A control in accordance with claim 1, wherein said switch means is mounted in close proximity to the lubricating oil contained in the oil sump of the compressor.

5. A control in accordance with claim 1, wherein the switch means is located in the refrigeration unit to sense the temperature of the refrigerant, the increase of temperature of the refrigerant caused by operation of the compressor causing the switch means to open to deenergize said heater.

* * * * *